US005332985A

United States Patent [19]

Hendel

[11] Patent Number: 5,332,985

[45] Date of Patent: Jul. 26, 1994

[54] ELECTROMAGNETIC SWITCHING SYSTEM AND PROCESS FOR PRODUCING THE SAME

[75] Inventor: Horst Hendel, Berlin, Fed. Rep. of Germany

[73] Assignee: Siemens Aktingesellschaft, Munich, Fed. Rep. of Germany

[21] Appl. No.: 952,728

[22] PCT Filed: May 2, 1991

[86] PCT No.: PCT/EP91/00836

§ 371 Date: Nov. 12, 1992

§ 102(e) Date: Nov. 12, 1992

[87] PCT Pub. No.: WO91/18408

PCT Pub. Date: Nov. 28, 1991

[30] Foreign Application Priority Data

May 14, 1990 [DE] Fed. Rep. of Germany ..... 90109037

[51] Int. Cl.[5] ..... H01H 51/22

[52] U.S. Cl. ..... 335/78; 335/251

[58] Field of Search ..... 335/78-86, 335/128, 251, 252, 250

[56] References Cited

U.S. PATENT DOCUMENTS 3,486,142 12/1969 Little .
3,524,153 8/1970 Little .

FOREIGN PATENT DOCUMENTS 1639295 6/1972 Fed. Rep. of Germany .
2226061 12/1973 Fed. Rep. of Germany .
3148052 6/1983 Fed. Rep. of Germany .
2341935 9/1977 France .
2517877 6/1983 France .

*Primary Examiner*—Lincoln Donovan
*Attorney, Agent, or Firm*—Hill, Steadman & Simpson

[57] ABSTRACT

In an electromagnetic switching system, axially arranged in a coil former (1), which carries a counter-contact element (12) in a flange (2), there is a core (5) which is firmly joined with one end (**5*b*) to an angular yoke (7). The yoke forms in addition a bearing for an armature (9), which forms a working air gap with a pole face (6) of the core and in addition carries a movable contact element (10). In order to maintain a contact follow (a) once it has been established, the core is firmly joined to the coil former (1) by means of holding elements (14) at as short an axial distance from the counter-contact element (12) as possible. The contact follow can be adjusted by displacement between coil former (1) and core (5**).

5 Claims, 2 Drawing Sheets

ELECTROMAGNETIC SWITCHING SYSTEM AND PROCESS FOR PRODUCING THE SAME

BACKGROUND OF THE INVENTION

The invention relates to an electromagnetic switching system having a coil former made of insulating material carrying a winding, a core which is arranged in an axial cutout of the coil former and forms a pole face with one end on the pole side and is firmly joined to a yoke with one end on the yoke side, an armature mounted on the yoke and forming a working air gap with the pole face of the core, at least one movable contact element that is operatively connected to the armature and at least one counter-contact element fastened on a flange of the coil former on the pole side. In addition, the invention relates to a process for producing such a switching system.

Such switching systems in the form of electromagnetic relays are known, for example, from German reference DE-A-1 639 295 (corresponding to U.S. Pat. Nos. 3,486,142 and 3,524,153) or French reference FR-A-2 341 935. In general, in switching systems of this type it has hitherto been customary to provide a fixed assignment between the coil former carrying the counter-contact elements on the one hand and the yoke on the other hand, the armature also being fixed by means of the bearing on the yoke. The contact force is determined in such systems by the contact follow. That is the additional path which the armature can still travel in the direction of the pole face after the contacts have closed until the stop. Said contact follow, and hence the contact force, has hitherto been set by means of so-called core pole adjustment. In this case the core is pressed into the coil former and with its end on the yoke side into a yoke cutout until it has reached a predetermined dimension with respect to the counter-contact elements. If this pressing in for the purpose of adjustment is performed before the armature and the movable contact elements are put in place, then the adjustment can only be performed on the basis of the dimensions determined, it being difficult to control tolerances. If, however, the core pole adjustment is performed with the armature in place by pressing in the core over the armature, then the latter may be deformed in an undesired manner. If the core is fastened in the yoke by pressing in and notching, high jointing and notching forces occur, which can only be reliably controlled if the core can be pressed into the yoke directly over the core pole face and without any intervening armature. In order to still be able to perform an adjustment of the assembled core even after the armature has been assembled, it has also already been proposed (German reference DE-A-3 148 052) to fasten the core in the yoke by means of a fine thread and to perform an adjustment by rotating the core after the armature has been assembled. However, the fine thread entails additional costly production steps.

An electromagnet is also known already from German reference DE-A-2 226 061, in which resilient detent tongues are provided for fixing the coil foyer on the magnet core in the region of the interior wall of the coil former, which detent tongues are received in a form-locking manner in complementary recesses in the magnet core. However this produces only an insufficient securing with respect to relative displacement of the coil foyer on the magnet yoke, in particular only in one direction. On the other hand, a clamping of the coil foyer onto lugs, not defined in more detail, of the magnet core mentioned therein in the introduction of the description is said to be disadvantageous.

However, even if a precise adjustment was performed between counter-contact elements and core pole face during production, a de-adjustment may occur as a result of aging and concomitant shrinkage of the coil foyer. For example, the coil foyer joined to the yoke can retract in the direction of the end on the yoke side as a result of the shrinkage, with the result that the counter-contact elements are also moved further away from the movable contact elements, that is to say the contact force is reduced. The reliability of the switching system is thereby impaired.

SUMMARY OF THE INVENTION

The object of the invention is to produce an electromagnetic switching system of the type mentioned at the beginning in which a shrinkage of the coil former material practically does not alter the adjustment between core pole face and counter-contact elements and hence does not impair the contact follow, and in which both a simple and stable fastening between core and yoke as well as an adjustment of the contact follow can be executed without any problems. The further intention of the invention is to state a process for advantageously producing and adjusting a switching system of this type.

According to the invention, this object is achieved with a switching system of the type mentioned at the beginning in that holding lugs which penetrate into the material of the coil former are impressed on the core in its end section on the pole side and secure the core and the coil former against relative axial displacement.

In the switching system according to the invention, therefore, the coil former does not, as in conventional systems, bear against the yoke or is not joined thereto with its end remote from the armature and from the pole face, but rather a join is specifically produced between core and coil former in the region of their ends on the pole side. Said form-locked and/or force-locked join between core and coil former thus exhibits no, or virtually no, axial displacement with respect to the counter-contact elements, so that distortion phenomena in the plastic of the coil former do not alter the assignment between core pole face and counter-contact elements. If the coil former shrinks, at worst a free space results between the end of the coil former on the yoke side and the yoke, but this does not affect the contact follow.

Since the assignment between core pole face and counter-contact elements in the switching system according to the invention is not dependent on the fastening between core and yoke, said fastening can be performed without regard to the adjustment before the assembly of the armature with a view to a best possible close fit. The adjustment of the contact follow can however be performed after the armature has been put in place by simple displacement of the coil former on the core, the displacement forces between the iron of the core and the plastic of the coil former being relatively small so that there is no risk of a deformation of the armature assembly during adjustment of the contact follow. The intended firm join at the end on the pole side according to the invention can nevertheless be achieved here. The core is fixed in the coil former by means, for example, of three or four holding lugs distributed over the circumference of the core which initially claw into the plastic of the coil former in a force-locked manner, then the join progressively changes into a force-locked join due to cold flowing of the plastic. The transition from force-lock to form-lock is further promoted by the action of heat, such as occurs by the heating up of the coil during operation for example.

A further advantage of the adjustment displacement of the entire magnet system in relation to the coil former is conferred by the fact that without gearing the follow change is exactly identical to the magnitude of the displacement path of the magnet system, which permits a high degree of precision in the adjustment. For displacing the magnet system, the coil former is supported, for example, by support pins, which penetrate the yoke, on the coil flange on the yoke side.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawing, and in which:

DESCRIPTION OF THE PREFERRED EMBODIMENT

Figure 1:
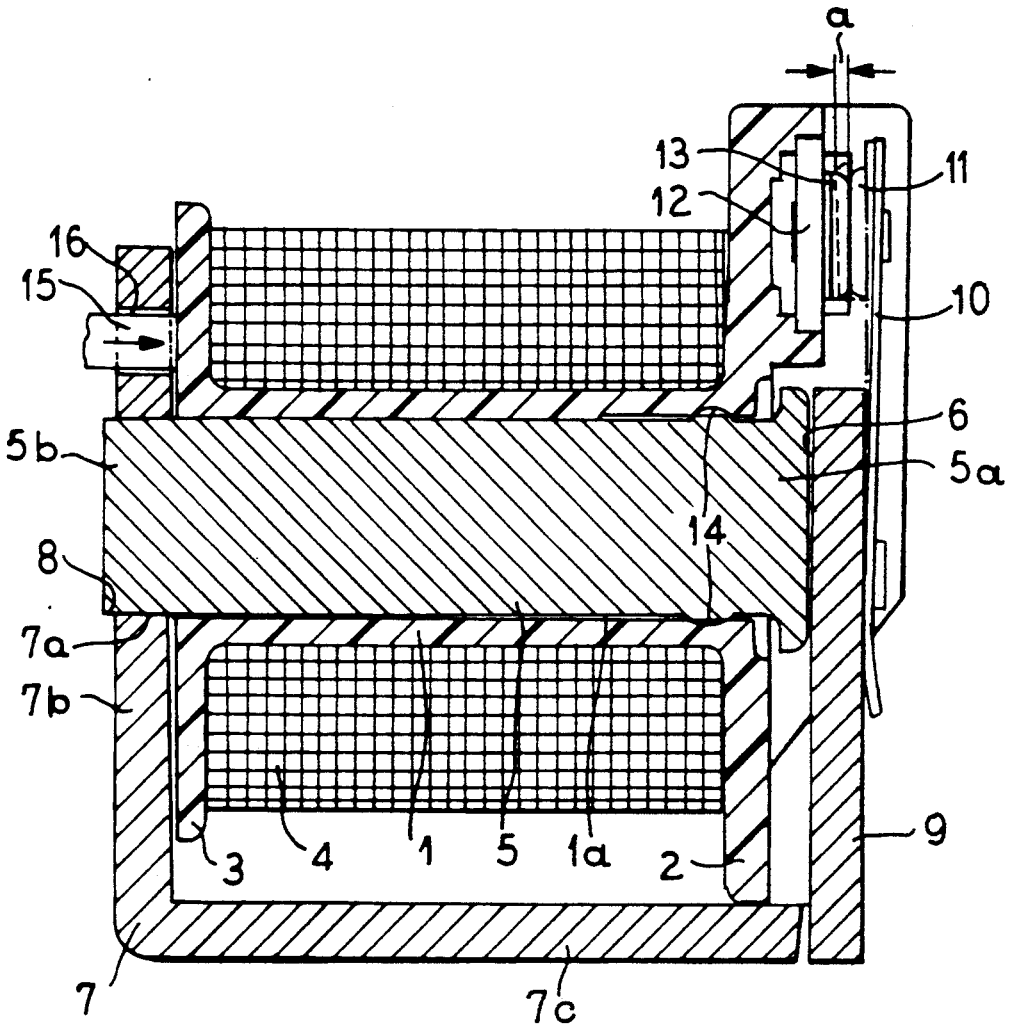
FIG. 1 shows a switching system according to the invention in a section along the coil axis.
Figure 2:
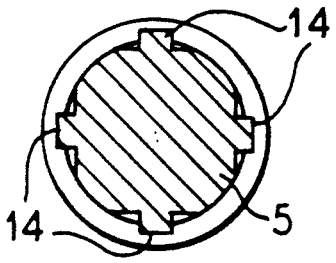
FIGS. 2 and 3 show two views of the core.
Figure 3:
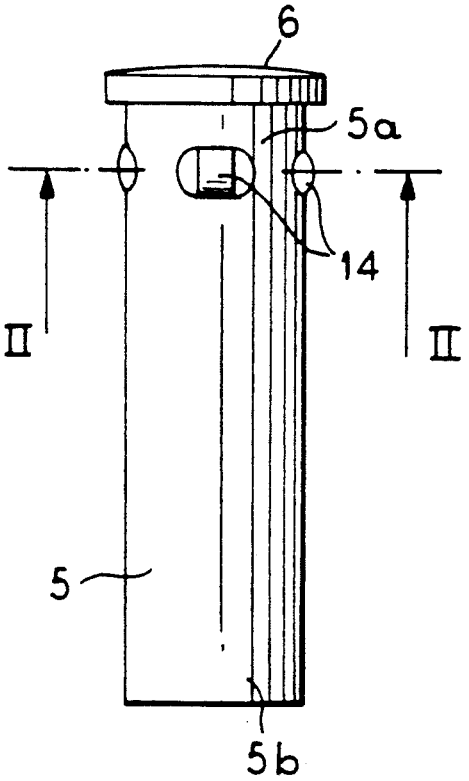

FIG. 1 shows a longitudinal section of an electromagnetic relay having a coil former 1 which has two flanges 2 and 3, between which a winding 4 is applied. A core 5 with an end 5*a* on the pole side and an end 5*b* on the yoke side is arranged in the axial bore 1*a* of the coil former. The end 5*a* on the pole side forms a pole face 6, while the end 5*b* on the yoke side is pressed into a cutout 7*a* of a yoke 7 and is fixed with notches 8. The yoke is bent in an angular fashion; the leg joined to the core is denoted by 7*b* while a second leg 7*c* extends parallel to the coil axis and forms a bearing for an armature 9. Said armature 9 forms a working air gap with the pole face 6.

A movable contact spring 10, which carries a contact piece 11, is joined to the armature 9. In addition, a fixed counter-contact element 12 is fastened to a contact piece 13 in the coil flange 2. When the relay is excited, the armature 9 is drawn to the end 5*a* of the core on the pole side and thus closes the contact between the contact pieces 11 and 13. The contact closes here already at a time at which the armature is not yet resting on the pole face 6. Until the armature rests against the pole face 6, the contact piece 11 would still travel a path a if the counter-contact element 12 or 13 were not present. This path a is termed the contact follow. It is needed to ensure the required contact pressure and to guarantee that the contact pieces function reliably even after erosion of a certain degree. Said contact follow a must be set to a predetermined value by suitable adjustment. It must also not alter in an inadmissible manner during the life of the relay, for example as a result of the coil former shrinking. If, for example, as is often the case, the coil flange 3 were firmly joined to the yoke leg 7*b*, then the counter-contact element 12 could move away from the contact spring 10 as a result of the coil former shrinking in the direction of the yoke leg 7*b* and thus reduce the contact follow.

In order to eliminate to a large extent an impairment of the contact follow due to aging of the coil former in the switching system according to the invention, the core 5 has, for example, four holding lugs 14 offset by 90° which are distributed over the circumference in the end section 5*a* on the pole side and which bury themselves into the coil former 1 in the region or in the vicinity of the coil flange 2. They thus bring about a fixing between core and coil former in the region of the coil flange 2, that is to say with a minimum axial distance from the counter-contact element 12. If the coil former shrinks, at worst it will move away with the flange 3 from the yoke leg 7*b*. The magnet system comprising core 5, yoke 7 and armature 9 remains in fixed axial assignment to the contact elements.

When the relay is assembled, first of all the core 5 is pushed into the wound coil former 1 and is pressed into the yoke cutout 7*a* and notched irrespective of the contact adjustment. It is possible to press directly on the pole face 6 with the tool here, without any intervening armature, as a result of which a good close fit between core and yoke is accomplished and a good magnetic transfer is ensured. After the armature and the contact elements have been assembled, the contact follow a can then be adjusted. For this purpose, the magnet system can be displaced in relation to the coil former 1 by pressing on the core over the armature 9 in axial direction. The coil former is supported here by support pins 15, which grip on the flange 3 through bores 16 of the yoke. In the case of said adjustment by means of axial displacement, no very great displacement forces are required between the plastic material of the coil former and the core, so that the armature is not deformed either. The holding lugs, which bury themselves thereby in the material of the coil former 1, initially have a force-locking effect. With increasing age and as a result of cold flowing of the plastic material, this force-lock gradually changes into a form-lock. This process is further promoted by the action of heat, for instance due to the heating up of the coil during operation.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electromagnetic switching system, comprising:

a coil former of insulating material carrying a winding, a core arranged in an axial cutout of the coil former, said core having a pole face on a first end of the core on a pole side and a second end of the core on a yoke side firmly joined to a yoke, an armature mounted on the yoke and forming a working air gap with the pole face of the core, at least one movable contact element that is operatively connected to the armature, at least one counter-contact element fastened on a flange of the coil former on the pole side, and holding lugs, which penetrate into the material of the coil former, impressed on the core in the first end on the pole side, said holding lugs securing the core and the coil former against relative axial displacement.

2. A switching system as claimed in claim 1, wherein a plurality of holding lugs are distributed over a circumference of the core.

3. A process for producing an electromagnetic switching system, comprising the steps of:

providing a coil former of insulating material carrying a winding, providing a core having a pole face on a first end of the core on a pole side and a second end of the core on a yoke side firmly joined to a yoke, providing an armature, providing at least one movable contact element that is operatively connected to the armature, providing at least one counter-contact element fastened on a flange of the coil former on the pole side, and providing holding lugs, which penetrate into the material of the coil former, impressed on the core in the first end on the pole side;

pushing the core through the wound coil former, pressing into the coil former with first end on the pole side and simultaneously pressing into a cutout of the yoke with the second end on the yoke side; and thereafter installing the armature with the movable contact element.

4. The process as claimed in claim 3, wherein, after the armature with the movable contact element has been installed, the coil former carrying the counter-contact element is displaced in an axial direction relative to a unit formed by the core and the yoke.

5. The process as claimed in claim 4, wherein during the displacement between the core and the coil former, the coil former is supported by support pins which are guided through cutouts of the yoke.

* * * * *